US009333556B2

(12) United States Patent
Kurosawa et al.

(10) Patent No.: US 9,333,556 B2
(45) Date of Patent: May 10, 2016

(54) CONTINUOUS CASTING METHOD FOR SLAB MADE OF TITANIUM OR TITANIUM ALLOY

(71) Applicant: Kobe Steel, Ltd., Hyogo (JP)

(72) Inventors: Eisuke Kurosawa, Kobe (JP); Takehiro Nakaoka, Kobe (JP); Kazuyuki Tsutsumi, Kobe (JP); Hideto Oyama, Takasago (JP); Hidetaka Kanahashi, Takasago (JP); Hitoshi Ishida, Kobe (JP); Daiki Takahashi, Kobe (JP); Daisuke Matsuwaka, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/646,366

(22) PCT Filed: Jan. 23, 2014

(86) PCT No.: PCT/JP2014/051423

§ 371 (c)(1),
(2) Date: May 20, 2015

(87) PCT Pub. No.: WO2014/115822

PCT Pub. Date: Jul. 31, 2014

(65) Prior Publication Data

US 2015/0306660 A1 Oct. 29, 2015

(30) Foreign Application Priority Data

Jan. 23, 2013 (JP) ..... 2013-010247

(51) Int. Cl.
*B22D 11/115* (2006.01)
*B22D 11/041* (2006.01)
(Continued)

(52) U.S. Cl.
CPC ..... *B22D 11/041* (2013.01); *B22D 11/001* (2013.01); *B22D 11/103* (2013.01);
(Continued)

(58) Field of Classification Search
CPC ..... B22D 11/115; B22D 11/005
USPC ..... 164/468, 469, 502–504, 508
See application file for complete search history.

(56) References Cited

U.S. PATENT DOCUMENTS 3,342,250 A * 9/1967 Treppschuh ..... B22D 11/00 164/258
4,565,238 A * 1/1986 Kojima ..... B22D 11/115 164/468
(Continued)

FOREIGN PATENT DOCUMENTS

JP 3077387 B2 8/2000
JP 4704797 B2 6/2011
WO 2005/025774 A2 3/2005

OTHER PUBLICATIONS

Malley et al., "Control of plasma hearth melted ingot surfaces", Proceedings of the tenth International Conference on Vacuum Metallurgy, Metallurgical Industry Press, 1991, pp. 178-188.*
(Continued)

*Primary Examiner* — Kevin E Yoon
(74) *Attorney, Agent, or Firm* — Studebaker & Brackett PC

(57) ABSTRACT

A continuous casting method in which a molten metal obtained by melting titanium or a titanium alloy is injected into a bottomless mold having a rectangular cross-section and withdrawn downward while being caused to solidify, wherein a plasma torch (7) is caused to rotate in the horizontal direction above the surface of the molten metal (12) in the mold (2), and a horizontally rotating flow is generated by electromagnetic stirring on at least the surface of the molten metal (12) in the mold (2). It is thereby possible to cast a slab in which the casting surface condition is excellent.

4 Claims, 24 Drawing Sheets

(51) Int. Cl.

| | |
|---|---|
| ***B22D 27/02*** | (2006.01) |
| ***B22D 11/103*** | (2006.01) |
| ***B22D 11/117*** | (2006.01) |
| ***B22D 21/00*** | (2006.01) |
| ***B22D 11/00*** | (2006.01) |
| ***B22D 11/11*** | (2006.01) |
| ***B22D 27/04*** | (2006.01) |

(52) U.S. Cl.
CPC ..... *B22D 11/11* (2013.01); *B22D 11/115* (2013.01); *B22D 11/117* (2013.01); *B22D 21/005* (2013.01); *B22D 27/02* (2013.01); *B22D 27/04* (2013.01)

(56) References Cited

U.S. PATENT DOCUMENTS

| | | | | |
|---|---|---|---|---|
| 6,938,674 | B2 * | 9/2005 | Eriksson ..... | B22D 11/115 164/466 |
| 2004/0056394 | A1 | 3/2004 | Jackson et al. | |

OTHER PUBLICATIONS

International Search Report; PCT/JP2014/051423; Mar. 18, 2014.
Written Opinion of the International Searching Authority; PCT/JP2014/051423; Mar. 18, 2014.

* cited by examiner

CONTINUOUS CASTING METHOD FOR SLAB MADE OF TITANIUM OR TITANIUM ALLOY

TECHNICAL FIELD

The invention relates to a continuous casting method for a slab made of titanium or a titanium alloy, in which a slab made of titanium or a titanium alloy is continuously cast.

BACKGROUND ART

Continuous casting of an ingot has been conventionally performed by injecting metal melted by vacuum arc melting and electron beam melting into a bottomless mold and withdrawing the molten metal downward while being solidified.

Patent Document 1 discloses an automatic control method for plasma melting casting, in which titanium or a titanium alloy is melted by plasma arc melting in an inert gas atmosphere and injected into a mold for solidification. Performing the plasma arc melting in an inert gas atmosphere, unlike the electron beam melting in vacuum, allows casting of not only pure titanium, but also a titanium alloy.

CITATION LIST

Patent Document

Patent Document 1: Japanese Patent No. 3077387

SUMMARY OF THE INVENTION

Problems to be Solved

However, if an ingot has irregularities and flaws on casting surface after casting, it is necessary to perform a pretreatment, such as cutting the surface, before rolling, thus causing a reduction in material utilization and an increase in number of operation processes. Therefore, it is demanded to cast an ingot without irregularities and flaws on casting surface.

Here consider the case where a thin slab having a size of, for example, 250×750 mm, 250×1000 mm, or 250×1500 mm is continuously cast by the plasma arc melting. In this case, since a plasma torch has a limited heating range, it is necessary to move the plasma torch in the horizontal direction along a mold having a rectangular cross section in order to suppress the growth of an initial solidified portion near the mold.

In the casting, the staying time of the plasma torch at long side parts of the mold is long, thus heat input into the initial solidified portion becomes large, resulting in forming a thin solidified shell. On the other hand, the staying time of the plasma torch at short side and corner parts of the mold is short, thus the heat input into the initial solidified portion is not sufficient, and as a result, the solidified shell becomes grown (thickened). As such, solidification behavior is uneven depending on positions in the thin slab, thereby leading to deterioration of casting surface properties.

An object of the present invention is to provide a continuous casting method for a slab made of titanium or a titanium alloy, capable of casting a slab having an excellent casting surface condition.

Means of Solving Problems

The continuous casting method for a slab made of titanium or a titanium alloy of the present invention is a method for continuous casting a slab made of titanium or a titanium alloy by injecting molten metal prepared by melting titanium or a titanium alloy into a bottomless mold having a rectangular cross section and withdrawing the molten metal downward while being solidified, the method being characterized in that a plasma torch is configured to rotate in the horizontal direction above the surface of the molten metal in the mold and a horizontally rotating flow is generated by electromagnetic stirring at least on the surface of the molten metal in the mold.

According to the configuration above, in addition to the rotary movement of the plasma torch, the horizontally rotating flow is generated by the electromagnetic stirring at least on the surface of the molten metal in the mold. In this configuration, the molten metal with higher temperature staying at the long side parts of the mold is moved to the short side and corner parts of the mold, thus the melting of the initial solidified portion at the long side parts of the mold and the growth of the initial solidified portion at the short side and the corner parts of the mold are alleviated. Consequently, solidification can take place evenly over the whole slab, thereby allowing the casting of the slab having an excellent casting surface condition.

Further, in the continuous casting method for a slab made of titanium or a titanium alloy of the present invention, when a length of the long side of the slab is denoted as L and a coordinate axis x is set in the long side direction of the slab, where the origin 0 lies at the central part thereof, in a vicinity of mold walls at the long side parts of the mold, absolute values of average values of flow rates in the x-axis direction at the surface of the molten metal located in a range of $-2L/5 \leq x \leq 2L/5$ may be set to 300 mm/sec or more. According to the configuration above, the molten metal with higher temperature staying at the long side parts of the mold can be preferably moved to the short side and the corner parts of the mold.

Further, in the continuous casting method for a slab made of titanium or a titanium alloy of the present invention, the vicinity of the mold walls at the long side parts of the mold may be a location 10 mm away from the mold walls at the long side parts of the mold. According to the configuration above, the molten metal with higher temperature staying at the long side parts of the mold can be preferably moved to the short side and the corner parts of the mold.

Further, in the continuous casting method for a slab made of titanium or a titanium alloy of the present invention, standard deviations $\sigma$ of the absolute values of the flow rates of the molten metal in the x-axis direction, concerning to variations due to locations and time, may be confined in a range of $50 \text{ mm/sec} \leq \sigma \leq 85 \text{ mm/sec}$. According to the configuration above, maximum values of fluctuation ranges of the surface temperature of the slab in a contact region where the molten metal and the slab contact with each other can be made 400° C. or less over the entire periphery of the slab.

Further, in the continuous casting method for a slab made of titanium or a titanium alloy of the present invention, a flow may be generated so as to rotate in the opposite direction of a rotational direction of the plasma torch at least on the surface of the molten metal. According to the configuration above, the fluctuation ranges of the surface temperature of the slab can be reduced. Thus solidification can take place evenly over the whole slab.

Effect of the Invention

According to the continuous casting method for a slab made of titanium or a titanium alloy of the present invention, the melting of the initial solidified portion at the long side parts of the mold and the growth of the initial solidified portion at the short side and the corner parts of the mold are alleviated. Consequently, solidification can take place evenly over the whole slab, thereby allowing the casting of the slab having an excellent casting surface condition.

DESCRIPTION OF EMBODIMENTS

Hereinafter, preferred embodiments of the present invention will be described with reference to the drawings.

(Configuration of Continuous Casting Apparatus)

Figure 1:
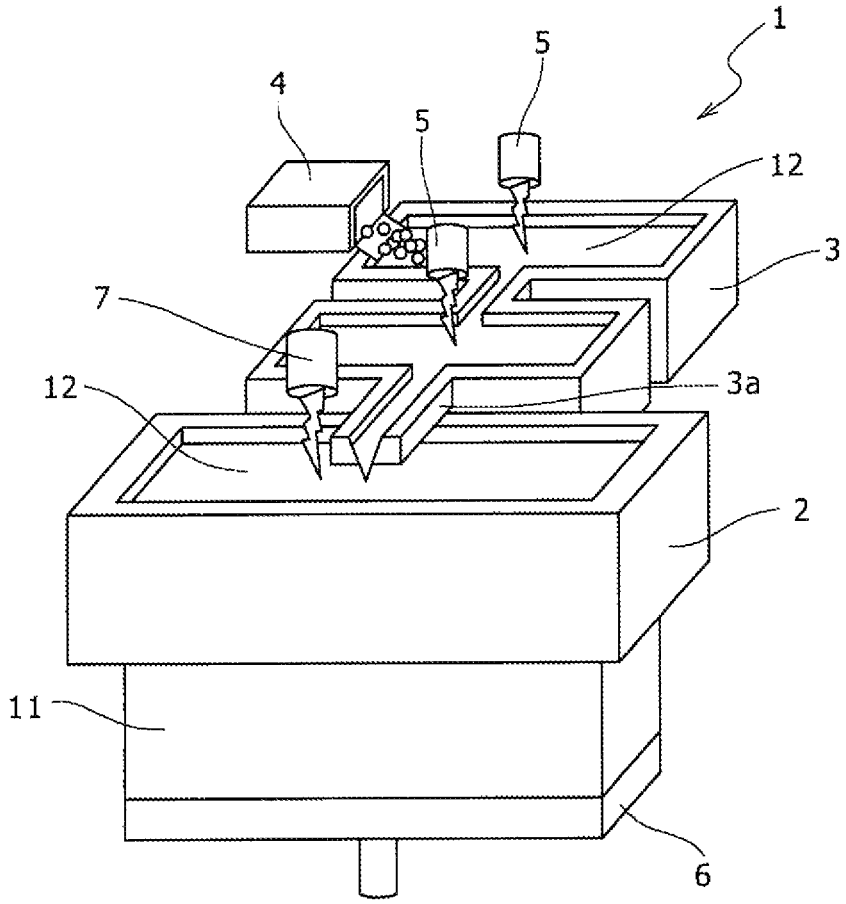
FIG. 1 is a perspective view of a continuous casting apparatus.
Figure 2:
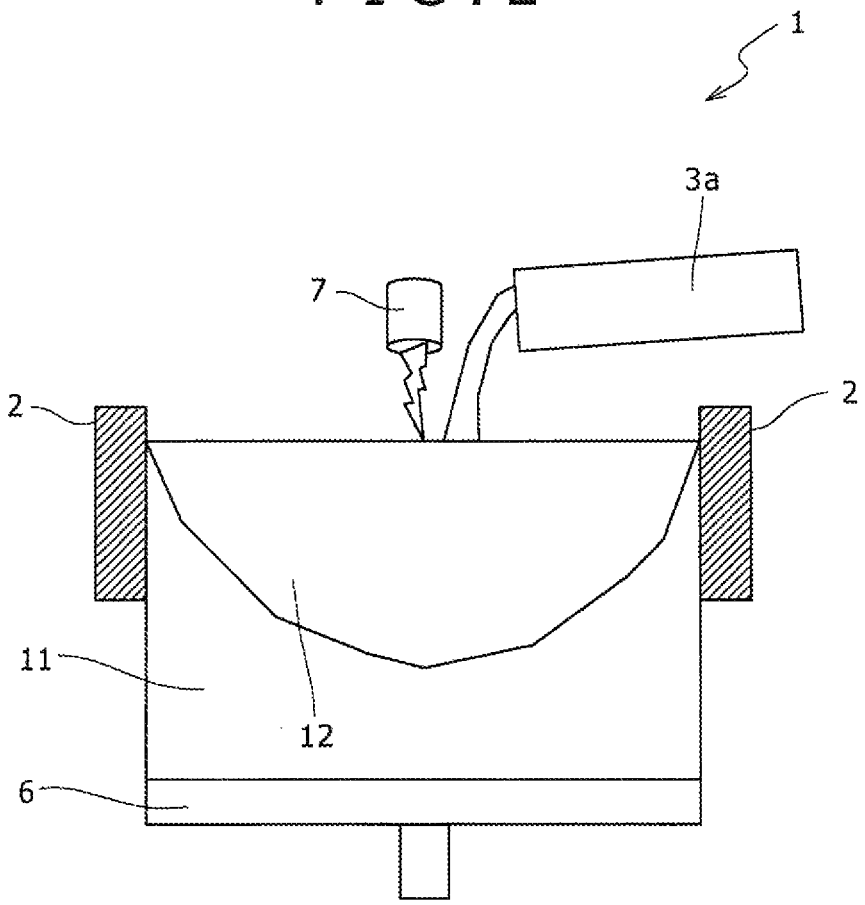
FIG. 2 is a cross-section view of the continuous casting apparatus.

In the continuous casting method for a slab made of titanium or a titanium alloy of the present embodiments, by injecting molten metal of titanium or a titanium alloy melted by plasma arc melting into a bottomless mold having a rectangular cross section and withdrawing the molten metal downward while being solidified, a slab made of the titanium or the titanium alloy is continuously cast. A continuous casting apparatus 1 carrying out the continuous casting method for a slab made of titanium or a titanium alloy, as shown in FIG. 1 depicting a perspective view thereof and FIG. 2 depicting a cross-section view thereof, includes a mold 2, a cold hearth 3, a raw material charging apparatus 4, a plasma torch 5, a starting block 6, and a plasma torch 7. The continuous casting apparatus 1 is surrounded by an inert gas atmosphere comprising argon gas, helium gas, and the like.

The raw material charging apparatus 4 supplies raw materials of titanium or a titanium alloy, such as sponge titanium, scrap and the like, into the cold hearth 3. The plasma torch 5 is disposed above the cold hearth 3 and used to melt the raw materials within the cold hearth 3 by generating plasma arcs. The cold hearth 3 injects molten metal 12 having the raw materials melted into the mold 2 through a pouring portion 3*a*. The mold 2 is made of copper and formed in a bottomless shape having a rectangular cross section. At least a part of a square cylindrical wall portion of the mold 2 is configured so as to circulate water through the wall portion, thereby cooling the mold 2. The starting block 6 is movable in the up and down direction by a drive portion not illustrated, and able to close a lower side opening of the mold 2. The plasma torch 7 is disposed above the molten metal 12 within the mold 2 and configured to horizontally move above the surface of the molten metal 12 by a moving means not illustrated, thereby heating the surface of the molten metal 12 injected into the mold 2 by the plasma arcs.

In the above configuration, solidification of the molten metal 12 injected into the mold 2 begins from a contact surface between the molten metal 12 and the mold 2 having a water-cooling system. Then, as the starting block 6 closing the lower side opening of the mold 2 is lowered at a predetermined speed, a slab 11 in a square cylindrical shape formed by solidifying the molten metal 12 is continuously cast while being withdrawn downward from the mold 2.

In this configuration, it is difficult to cast a titanium alloy using the electron beam melting in a vacuum atmosphere since trace components in the titanium alloy would evaporate. In contrast, it is possible to cast not only pure titanium, but also the titanium alloy using the plasma arc melting in an inert gas atmosphere.

Further, the continuous casting apparatus 1 may include a flux loading device for applying flux in a solid phase or a liquid phase onto the surface of the molten metal 12 in the mold 2. In this configuration, it is difficult to apply the flux to the molten metal 12 in the mold 2 using the electron beam melting in a vacuum atmosphere since the flux would be scattered. In contrast, the plasma arc melting in an inert gas atmosphere has an advantage that the flux can be applied to the molten metal 12 in the mold 2.

(Operational Conditions)

When a slab 11 made of titanium or a titanium alloy is produced by continuous casting, if there are irregularities or flaws on the surface of the slab 11 (casting surface), they would cause surface detects in a rolling process, which is the next step. Thus such irregularities or flaws on the surface of the slab 11 must be removed before rolling by cutting or the like. However, this step would decrease the material utilization and increase the number of operation processes, thereby increasing the cost of continuous casting. As such, it is demanded to perform the casting of the slab 11 without irregularities or flaws on its surface.

Figure 3A:
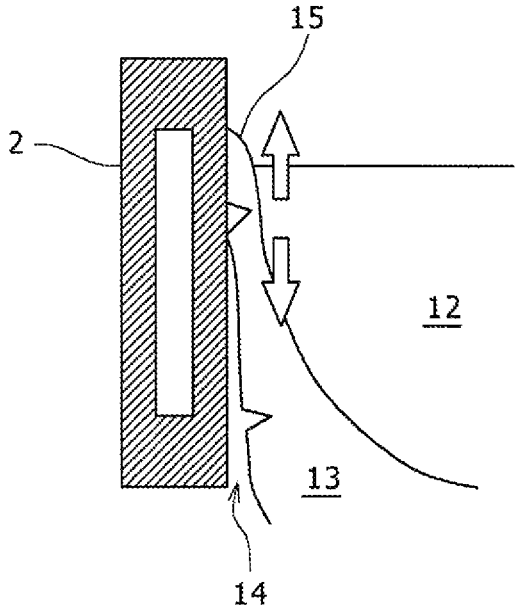
FIG. 3A is a drawing describing a causing mechanism of surface defects.
Figure 3B:
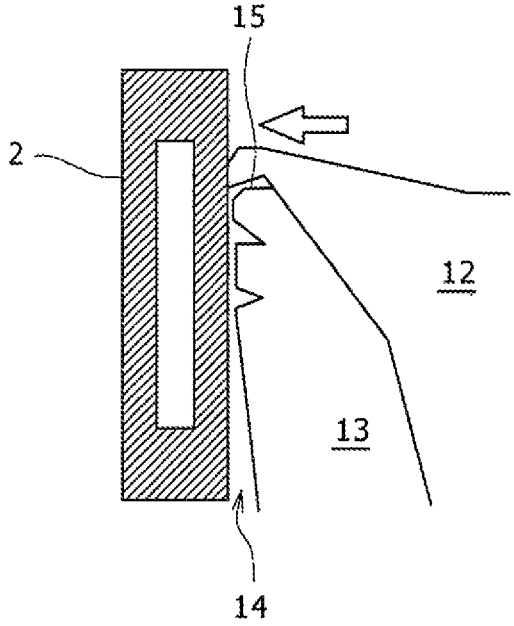
FIG. 3B is a drawing describing the causing mechanism of the surface defects.

As shown in FIGS. 3A and 3B, in continuous casting of the slab 11 made of titanium, the surface of the slab 11 (a solidified shell 13) contacts with the surface of the mold 2 only near a molten metal surface region (a region extending from the molten metal surface to an approximately 10-20 mm depth), where the molten metal 12 is heated by the plasma arcs or the electron beam. In a region deeper than this contact region, the slab 11 undergoes thermal shrinkage, thus an air gap 14 is generated between the slab 11 and the mold 2. Then, as shown in FIG. 3A, if the heat input to an initial solidified portion 15 (a portion of the molten metal 12 initially brought into contact with the mold 2 to be solidified) is excessive, since the solidified shell 13 becomes too thin, there occurs a "tearing-off defect", in which the surface portion of the solidified shell 13 is torn off due to lack of strength. On the other hand, as shown in FIG. 3B, if the heat input into the initial solidified portion 15 is not sufficient, there occurs a "molten metal-covering defect", in which the solidified shell 13 that has been grown (thickened) is covered with the molten metal 12. Therefore, it is speculated that heat input/output conditions applying to the initial solidified portion 15 of the molten metal 12 near the molten metal surface region would have a great impact on properties of the casting surface, and it is considered that the slab 11 having an excellent casting surface can be obtained by appropriately controlling the heat input/output conditions applying to the molten metal 12 near the molten metal surface region.

Figure 4A:
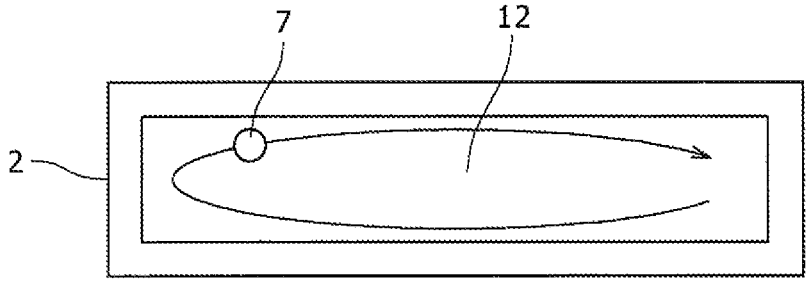
FIG. 4A is a model diagram of a mold, seen from above.
Figure 4B:
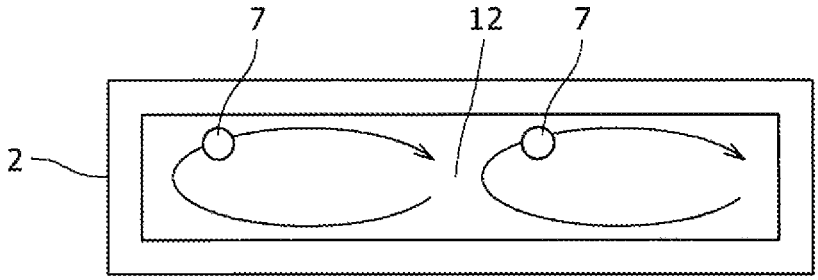
FIG. 4B is a model diagram of the mold, seen from above.
Figure 4C:
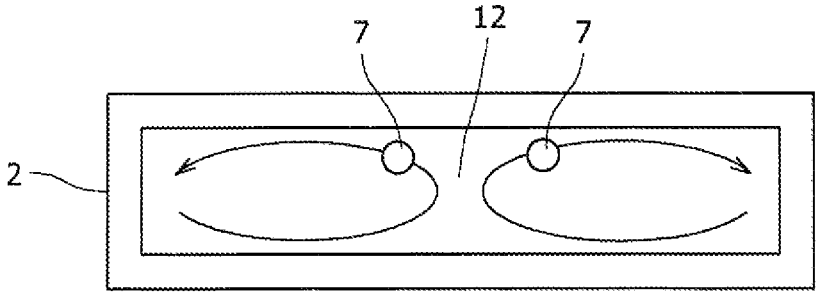
FIG. 4C is a model diagram of the mold, seen from above.

In this configuration, when the slab 11 having a size of, for example, 250×750 mm, 250×1000 mm, or 250×1500 mm is continuously cast by the plasma arc melting, a plasma torch 7 has a limitation to the heating range. Thus, in the present embodiments, as shown in FIGS. 4A, 4B, and 4C depicting model diagrams of the mold 2 seen from the above, the plasma torch 7 is configured to horizontally rotate above the molten metal 12. FIG. 4A shows a track of one plasma torch 7 rotating alone. On the other hand, FIGS. 4B and 4C show tracks of two plasma torches 7 rotating in the same time. In FIG. 4B, two plasma torches 7 are rotated in the same direction, while in FIG. 4C, two plasma torches 7 are rotated in the opposite direction.

However, when the plasma torch 7 is configured to rotate, the staying time of the plasma torch 7 at the long side parts of the mold 2 is long, thus the heat input into the initial solidified portion 15 becomes large, resulting in forming the thin solidified shell 13. On the other hand, the staying time of the plasma torch 7 at the short side and the corner parts of the mold 2 is short, thus the heat input into the initial solidified portion 15 becomes insufficient, and as a result, the solidified shell 13 becomes grown (thickened). For such reason, the solidification behavior becomes uneven depending on the positions in the slab 11, thereby leading to deterioration of casting surface properties.

Thus, in the present embodiments, an electromagnetic stirring apparatus (EMS: In-mold Electro-Magnetic Stirrer), not illustrated, is disposed on a side of the mold 2 and used to stir at least on the surface of the molten metal 12 in the mold 2 by electromagnetic induction. The EMS is an apparatus having a coil iron core wound by an EMS coil. By stirring the molten metal 12 by the EMS, a horizontally rotating flow is generated on or near the surface of the molten metal 12.

In this configuration, the molten metal 12 with higher temperature staying at the long side parts of the mold 2 is moved to the short side and the corner parts of the mold 2, thus the melting of the initial solidified portion 15 at the long side parts of the mold 2 and the growth of the initial solidified portion 15 at the short side and the corner parts of the mold 2 are alleviated. Consequently, solidification can take place evenly over the whole slab 11, thus allowing the casting of the slab 11 having an excellent casting surface condition.

Figure 5:
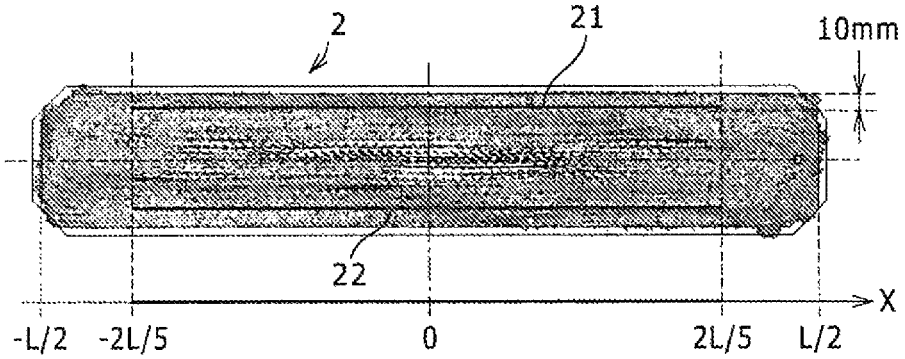
FIG. 5 is a top view of a mold.

It has been known that when average values of the surface temperature TS of the slab 11 in the contact region between the mold 2 and the slab 11 are in the range of 800° C.<TS<1250° C., the slab 11 having an excellent casting surface condition can be obtained. Based on this, in the present embodiments, as shown in FIG. 5 depicting a top view of the mold 2, a length of a long side of the slab 11 is denoted as L and a coordinate axis x is set in the long side direction of the slab 11, where the origin 0 lies at the central part thereof. Then, in a vicinity of mold walls at the long side parts of the mold 2, absolute values of flow rate average values Vm in the x-axis direction on the surface of the molten metal 12 located in a range of $-2L/5 \leq x \leq 2L/5$ are set to 300 mm/sec or more. The vicinity of the mold walls at the long side parts of the mold 2 described herein is a location 10 mm away from the mold walls at the long side parts of the mold 2.

In this configuration, the molten metal 12 with higher temperature staying at the long side parts of the mold 2 can be preferably moved to the short side and the corner parts of the mold 2.

Further, as described herein below, standard deviations $\sigma$ of the absolute values of the flow rates Vx of the molten metal 12 in the x-axis direction, concerning to variations due to locations and time, is confined in a range of $50 \text{ mm/sec} \leq \sigma \leq 85$ mm/sec.

In this configuration, maximum values of temperature fluctuation ranges of the surface temperature of the slab 11 in the contact region where the molten metal 12 and the slab 11 contact with each other can be made 400° C. or less over the entire periphery of the slab 11.

It is noted that the rotational direction of the flow generated at least on the surface of the molten metal 12 may be the same as or different from the rotational direction of the plasma torch 7. However, the fluctuation ranges of the surface temperature of the slab 11 can be reduced by the flow having the rotational direction opposite to the rotational direction of the plasma torch 7, generated at least on the surface of the molten metal 12.

(Simulations)

Next, in order to obtain a slab 11 having an excellent casting surface over the entire periphery of the slab 11, a moving pattern of the plasma torch 7 and an electromagnetic stirring pattern were examined by numerical simulations.

Figure 6A:
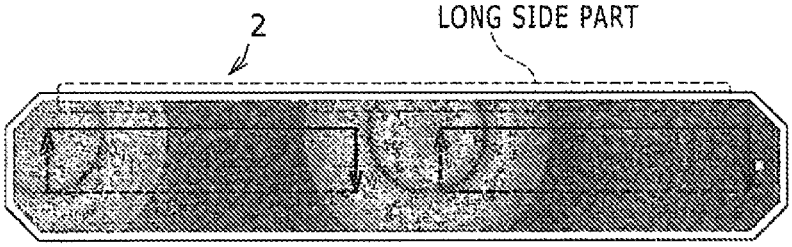
FIG. 6A is a top view of a mold.
Figure 6B:
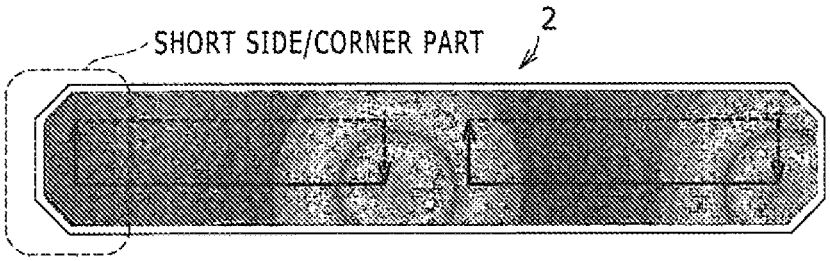
FIG. 6B is a top view of the mold.
Figure 7A:
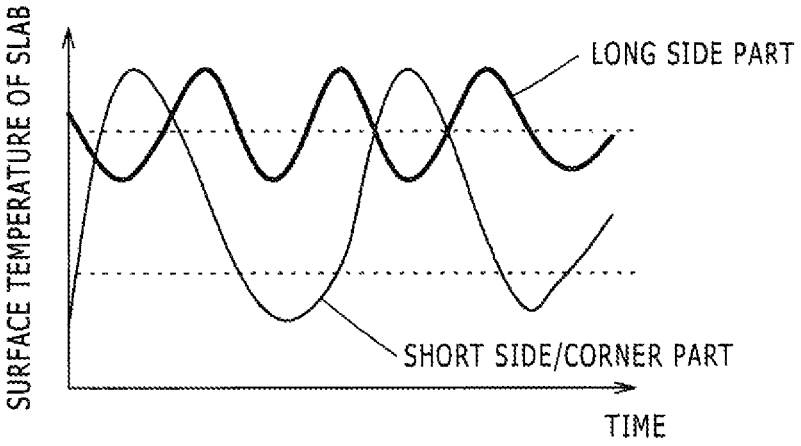
FIG. 7A is a conceptual diagram showing fluctuation of the surface temperature of a slab over the time.
Figure 7B:
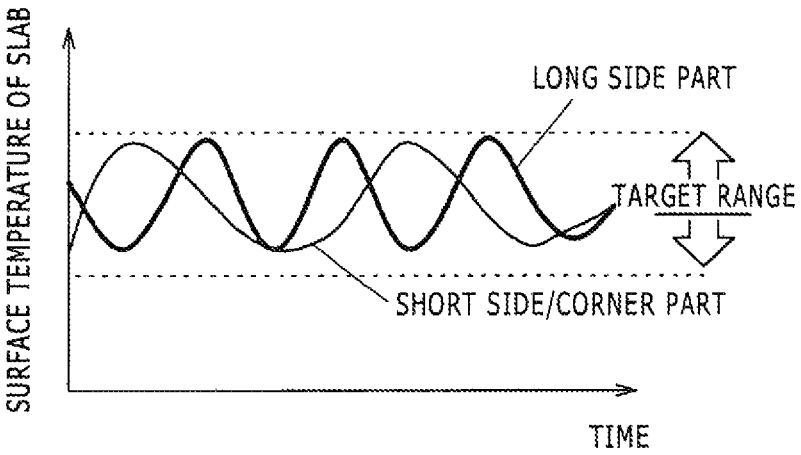
FIG. 7B is a conceptual diagram showing the fluctuation of the surface temperature of the slab over the time.

Firstly, as shown in FIGS. 6A and 6B depicting top views of the mold 2, long sides parts and short side/corner parts are each designated in the mold 2. FIGS. 7A and 7B show a conceptual diagram depicting the fluctuation of the surface temperature of the slab 11 over the time at the long side parts and the short side/corner parts of the mold 2.

FIG. 7A shows the fluctuation of the surface temperature of the slab 11 over the time in the case where only the plasma torch 7 is moved without performing the electromagnetic stirring. The heating time of the plasma torch 7 is long at the long side parts, thus the molten metal 12 with higher temperature stays there. On the other hand, at the short side/corner parts, the staying time of the plasma torch 7 is short, thus the temperature fluctuation ranges are larger. FIG. 7B shows the fluctuation of the surface temperature of the slab 11 over the time in the case where, in addition to the movement of the plasma torch 7, the electromagnetic induction is performed. It is found that the temperature fluctuation ranges are made almost the same over the whole slab 11 by moving the molten metal 12 with higher temperature staying at the long side parts to the short side/corner parts.

Figure 8:
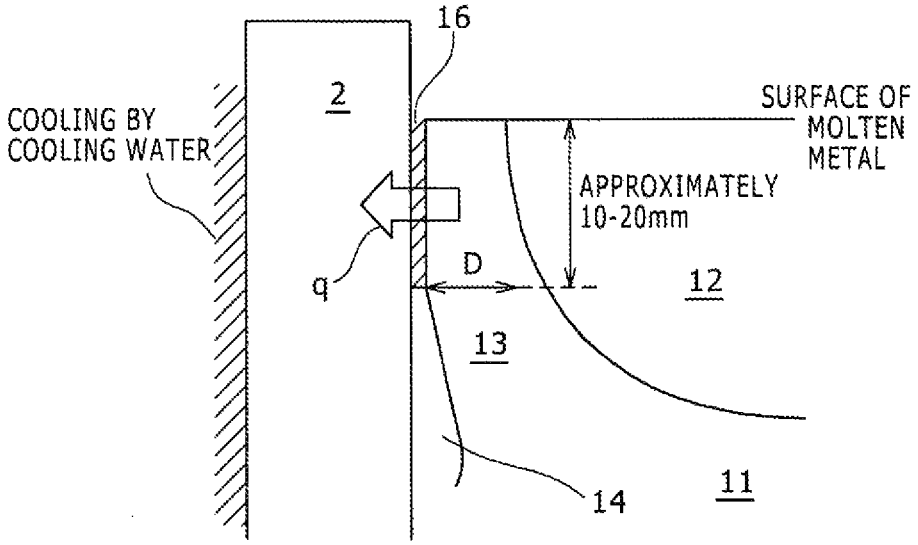
FIG. 8 is a model diagram showing a contact region between a mold and a slab.

Next, average values of the surface temperature TS of the slab 11 at the contact region between the mold 2 and the slab 11 were evaluated. FIG. 8 shows a model diagram depicting the contact region between the mold 2 and the slab 11. The contact region 16 is a region extending from the surface of the molten metal to an approximately 10-20 mm depth where the mold 2 and the slab 11 are in contact, shown by hatching in the figure. In the contact region 16, a passing heat flux q from the surface of the slab 11 to the mold 2 is generated. The thickness of a solidified shell 13 is denoted as D.

Figure 9:
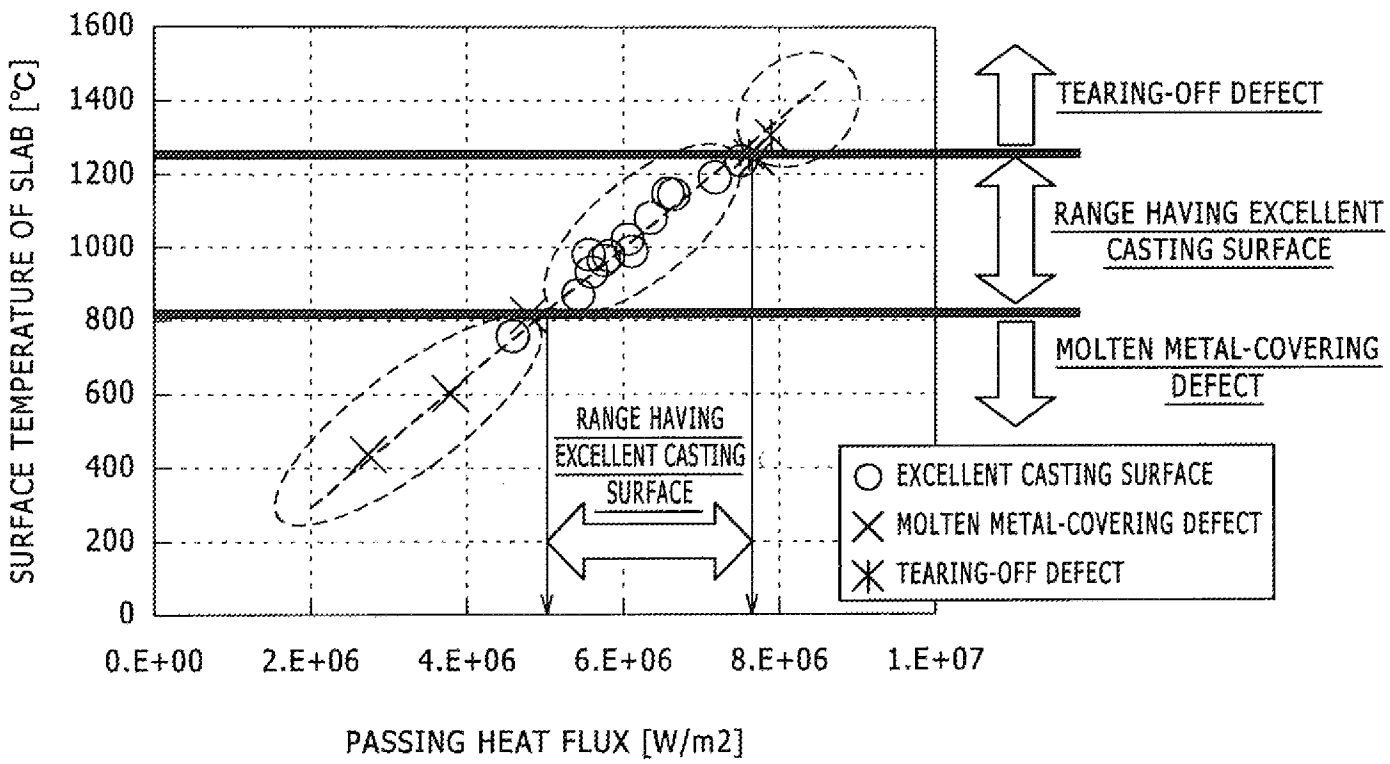
FIG. 9 is a graph showing the relation between a passing heat flux and the surface temperature of a slab.

FIG. 9 shows the relation between the passing heat flux q and the surface temperature TS of the slab 11. It is found that when the average values of the surface temperature TS of the slab 11 in the contact region 16 between the mold 2 and the slab 11 are in the range of 800° C.<TS<1250° C., the slab 11 having an excellent casting surface can be obtained without a tearing-off defect or a molten metal-covering defect. It is also found that average values of the passing heat flux q from the surface of the slab 11 to the mold 2 in the contact region 16 are in the range of 5 $MW/m^2<q<7.5$ $MW/m^2$, the slab 11 having an excellent casting surface can be obtained without the tearing-off defect or the molten metal-covering defect.

Figure 10A:
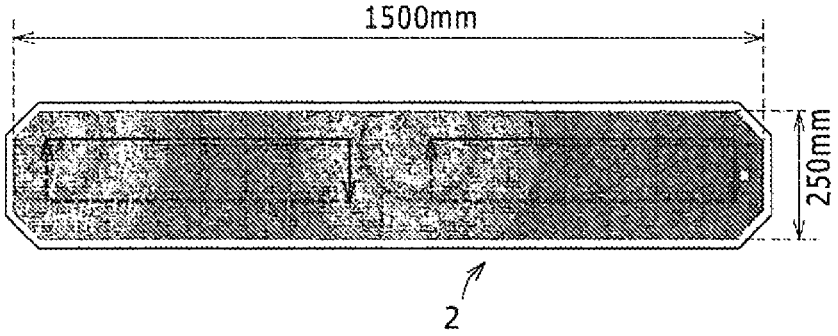
FIG. 10A is a diagram showing a moving pattern of a plasma torch and heat input distribution on the surface of molten metal.
Figure 10B:
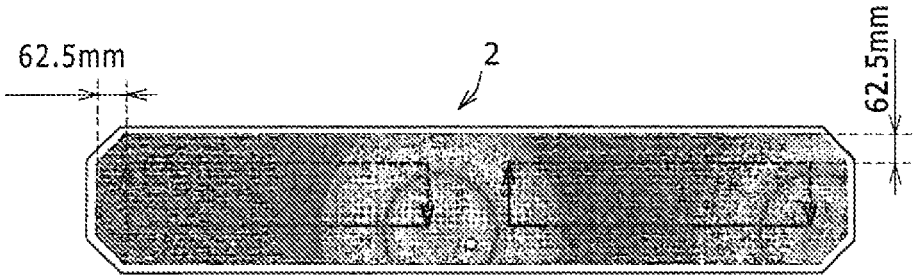
FIG. 10B is a diagram showing the moving pattern of the plasma torch and the heat input distribution on the surface of the molten metal.

Next, the surface temperature of the slab 11 was evaluated while changing the moving pattern of the plasma torch 7 and the electromagnetic stirring pattern. FIGS. 10A and 10B show the moving patterns of two plasma torches 7 and heat input distribution on the surface of molten metal. The inner peripheral length of the mold 2 is 250×1500 mm, and an output of the plasma torches 7 is 750 kW for each. A moving speed of the plasma torches 7 is 50 mm/min, and a moving cycle of the plasma torches 7 is 30 sec. A dissolving rate is 1.3 ton/hour. The plasma torches 7 are configured to rotate about 62.5 mm inside from the mold walls of the mold 2.

Figure 11A:
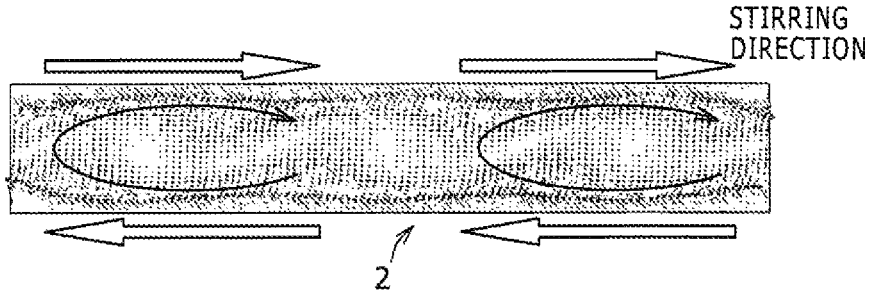
FIG. 11A is a diagram showing an electromagnetic stirring pattern and distribution of Lorentz force.
Figure 11B:
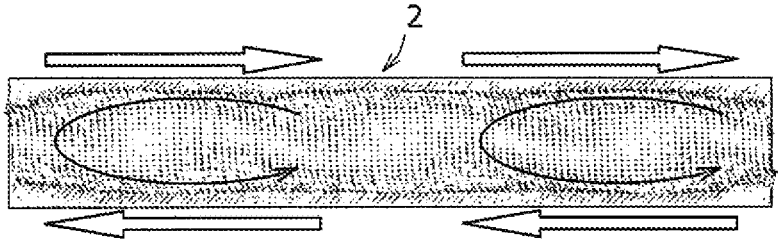
FIG. 11B is a diagram showing the electromagnetic stirring pattern and the distribution of Lorentz force.

FIGS. 11A and 11B show the electromagnetic stirring pattern and distribution of Lorentz force. In FIG. 11A, the rotational direction of a flow created by the electromagnetic stirring is the same as the rotational direction of the plasma torch 7, while in FIG. 11B, the rotational direction of the flow created by the electromagnetic stirring is opposite to the rotational direction of the plasma torch 7. Stirring strength of the electromagnetic induction was adjusted by changing coil current. It is noted that the stirring strength becomes larger as the coil current value is increased.

Figure 12:
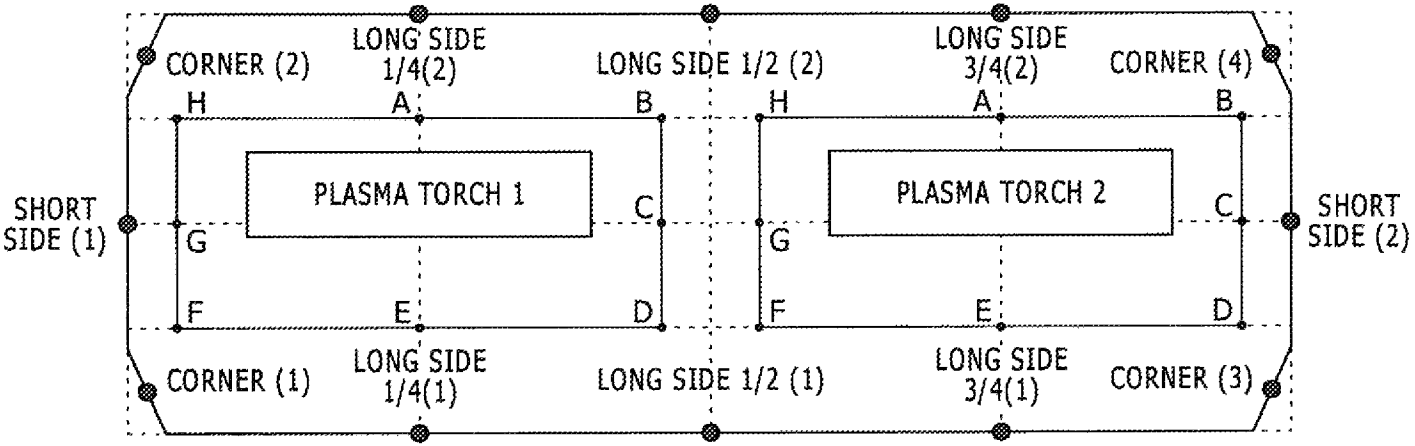
FIG. 12 is a diagram showing positions for data extraction and positions of plasma torches.

For the evaluation, positions for data extraction and positions of the plasma torches 7 were set as shown in FIG. 12. First, the center positions of each of two plasma torches 7 are set as positions A to H. The positions for data extraction are set along the inner periphery of the mold 2, which include the following 12 places: corners (1) to (4), long sides ¼ (1) and (2), long sides ½ (1) and (2), long sides ¾ (1) and (2), and short sides (1) and (2). Then, the surface temperature of the slab 11 was evaluated in five patterns, namely Cases 1 to 5. Details of the patterns of Cases 1 to 5 are shown in Table 1.

TABLE 1

| | Coil current [$AT/m^2$] | Stirring direction |
|---|---|---|
| Case 1 | No stirring | — |
| Case 2 | 2.6E5 | Same as rotational direction of plasma torch |
| Case 3 | 1.0E6 | Same as rotational direction of plasma torch |
| Case 4 | 4.1E6 | Same as rotational direction of plasma torch |
| Case 5 | 1.0E6 | Opposite to rotational direction of plasma torch |

Figure 13:
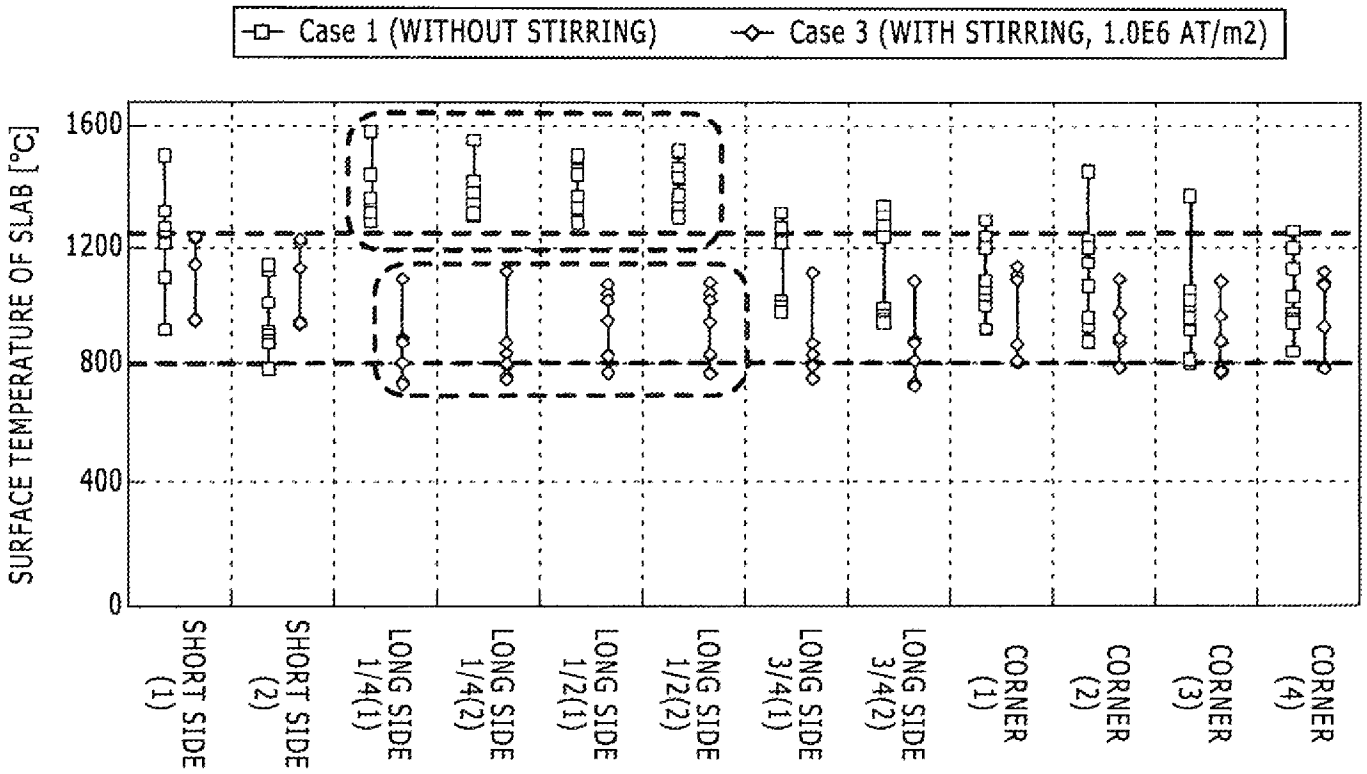
FIG. 13 is a diagram showing the surface temperature of a slab at each position for data extraction.
Figure 14:
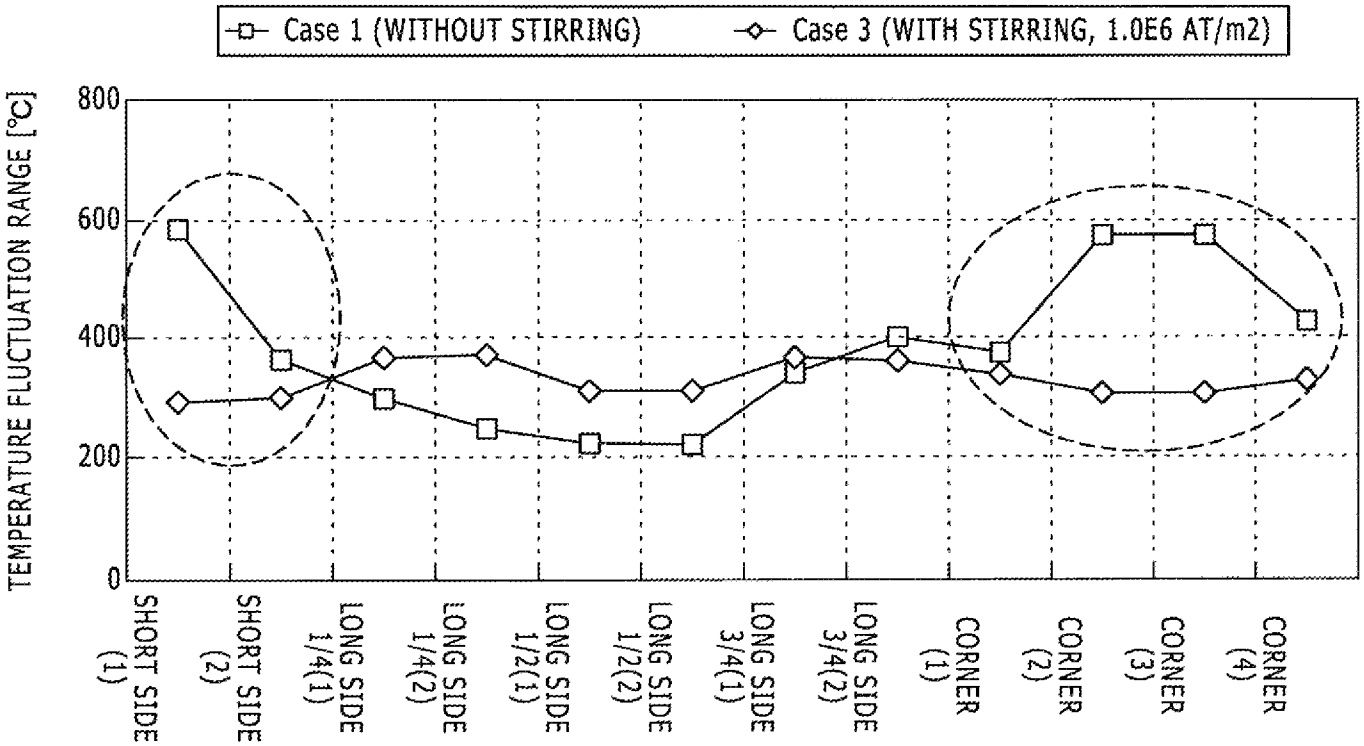
FIG. 14 is a diagram showing a temperature fluctuation range at each position for data extraction.

FIG. 13 shows the surface temperature of the slab 11 at each position for data extraction in Case 1 where the electromagnetic stirring is not performed and Case 3 where the electromagnetic stirring is rotated in the same direction as the rotational direction of the plasma torch 7. FIG. 14 shows the temperature fluctuation ranges at each position for data extraction in Case 1 and Case 3. It is found from FIG. 13 that the surface temperature of the slab 11 is significantly reduced by the electromagnetic stirring only in the long side parts of the slab 11. Further, it is found that the surface temperature of the slab 11 is fluctuated within substantially the same range over the entire periphery of the slab 11 by the electromagnetic stirring. It is also found from FIG. 14 that the fluctuation ranges of the surface temperature of the slab 11 are reduced in the short side/corner parts of the mold 2 by the electromagnetic stirring. Finally, it is found that the fluctuation ranges of the surface temperature of the slab 11 are almost in the same level by the electromagnetic stirring independently of the positions for data extraction.

Figure 15:
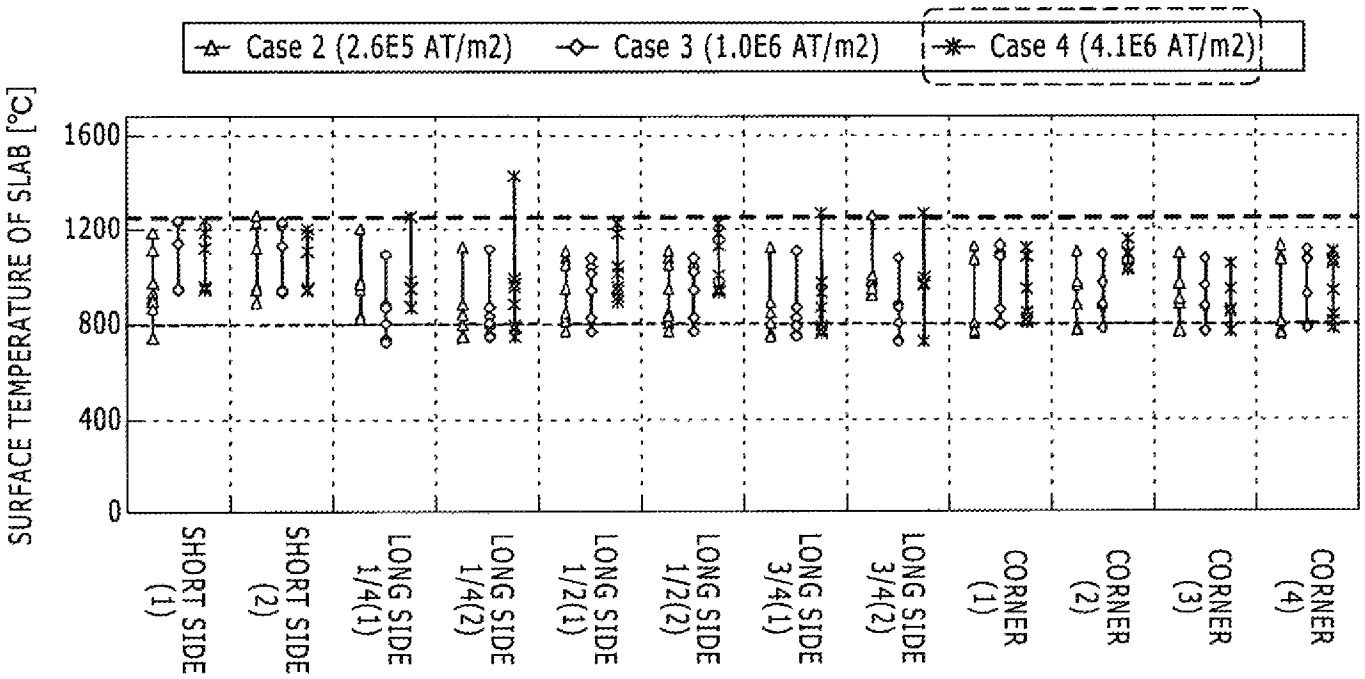
FIG. 15 is a diagram showing the surface temperature of a slab at each position for data extraction.
Figure 16:
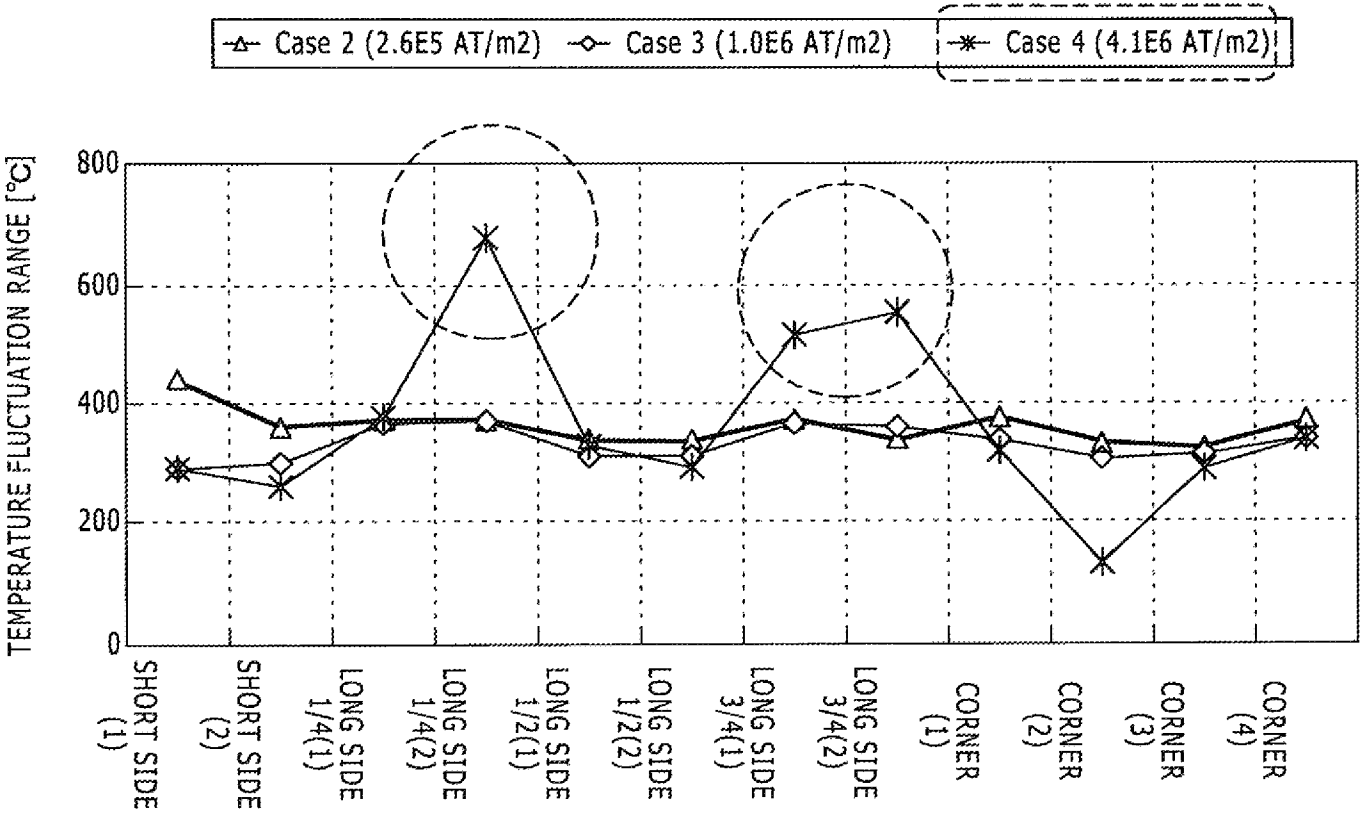
FIG. 16 is a diagram showing a temperature fluctuation range at each position for data extraction.

Next, FIG. 15 shows the surface temperatures of the slab 11 at each position for data extraction in Cases 2 to 4, among which the stirring strength of the electromagnetic stirring differs. FIG. 16 shows the temperature fluctuation ranges at each position for data extraction in Cases 2 to 4. It is found from FIG. 16 that variations arise in the fluctuation ranges of the surface temperatures of the slab 11 depending on the positions for data extraction by increasing the stirring strength of the electromagnetic stirring. It is speculated that this is because the flow of the molten metal 12 is disturbed.

Figure 17:
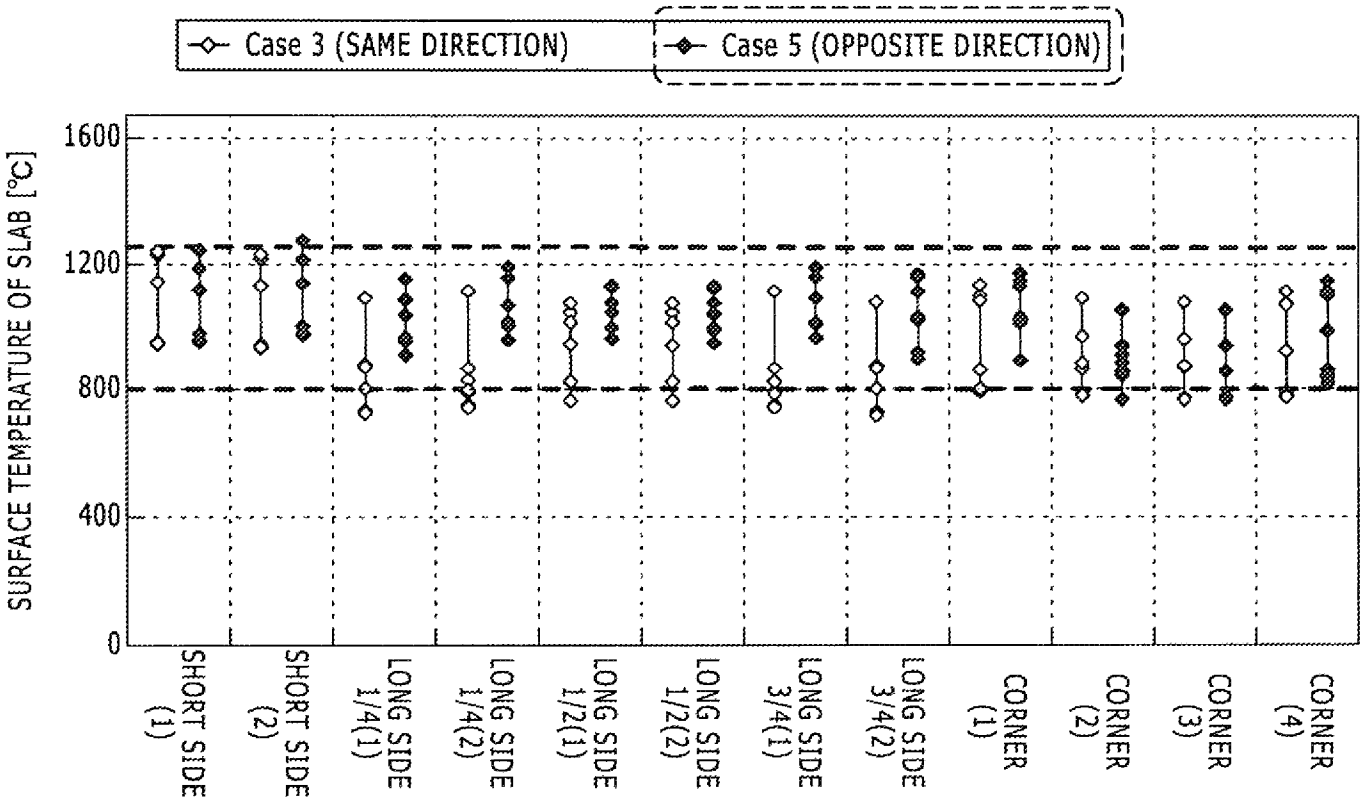
FIG. 17 is a diagram showing the surface temperature of a slab at each position for data extraction.
Figure 18:
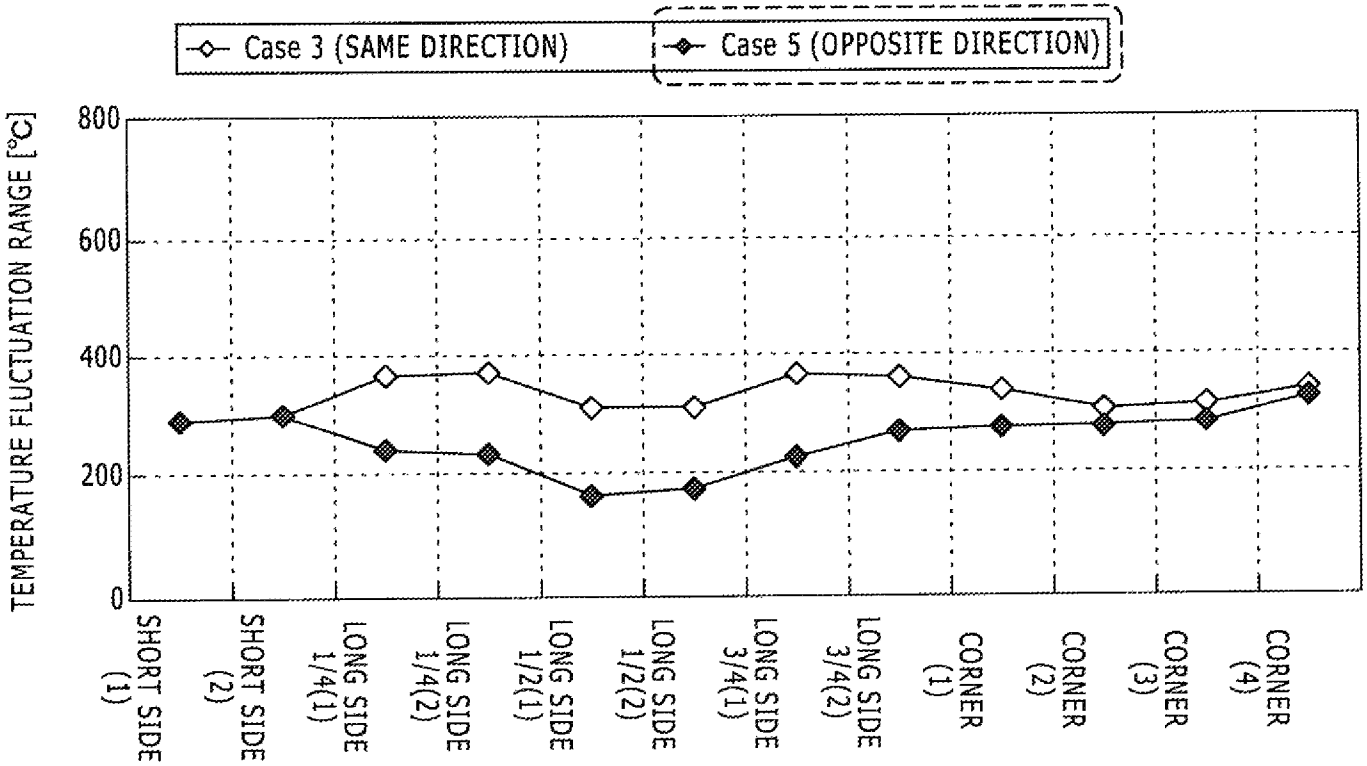
FIG. 18 is a diagram showing a temperature fluctuation range at each position for data extraction.

Next, FIG. 17 shows the surface temperature of the slab 11 at each position for data extraction in Case 3 where the electromagnetic stirring is performed in the same direction as the rotational direction of the plasma torches 7 and in Case 5 where the electromagnetic stirring is performed in the opposite direction to the rotational direction of the plasma torches 7. Further, FIG. 18 shows the temperature fluctuation ranges at each position for data extraction in Case 3 and Case 5. It is found from FIG. 18 that, by performing the electromagnetic stirring in the opposite direction to the rotational direction of the plasma torches 7, the fluctuation ranges of the surface temperature of the slab 11 are further reduced, thus falling substantially within a target range in an entire region.

Figure 19A:
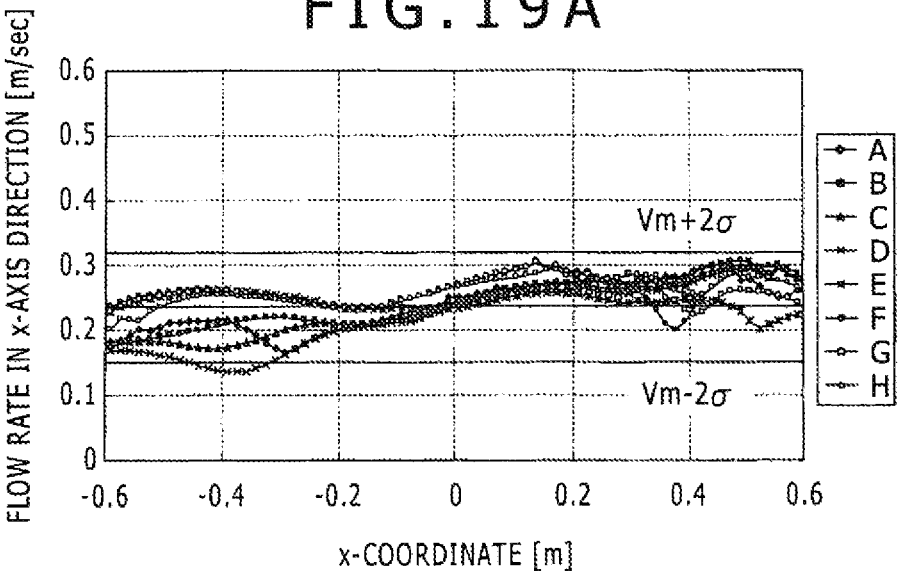
FIG. 19A is a graph showing flow rates measured on each line.
Figure 19B:
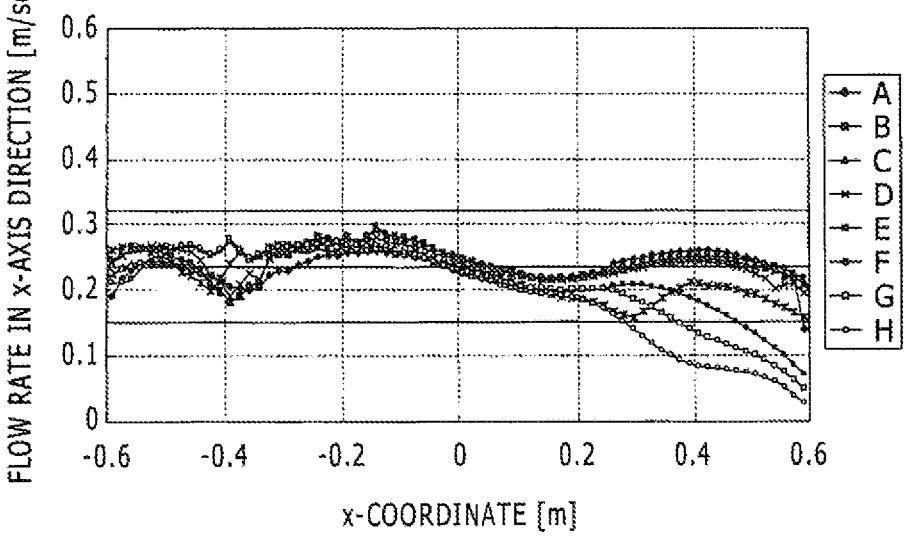
FIG. 19B is a graph showing the flow rates measured on each line.

Next, the flow rates of the molten metal 12 were evaluated in each condition of Cases 1 to 5. The evaluation was performed by using absolute values of the flow rates in an x-axis direction on lines 21 and 22, which are located 10 mm away from the mold walls at the long side parts of the mold 2 and set in a range from −2L/5 to 2L/5 in the x-coordinate, as seen in FIG. 5. Then, the flow rates were outputted when the center of the plasma torch 7 reached to the positions A to H. It is noted that, in the present simulations, top element values in a computation model are outputted to obtain calculated flow rates on the surface of the molten metal for evaluation. FIG. 19A shows the flow rates measured on the line 21 in Case 2. FIG. 19B shows the flow rates measured on the line 22 in Case 2. It is found that the flow rates on the line 21 in Case 2 have little variations caused by positions and time, thus the stable flow can be generated. On the other hand, it is also found that the average flow rate on the line 22 in Case 2 is 236 mm/sec and this flow rate is too small to sufficiently move the molten metal 12 to the short side/corner parts of the mold 2.

Figure 20A:
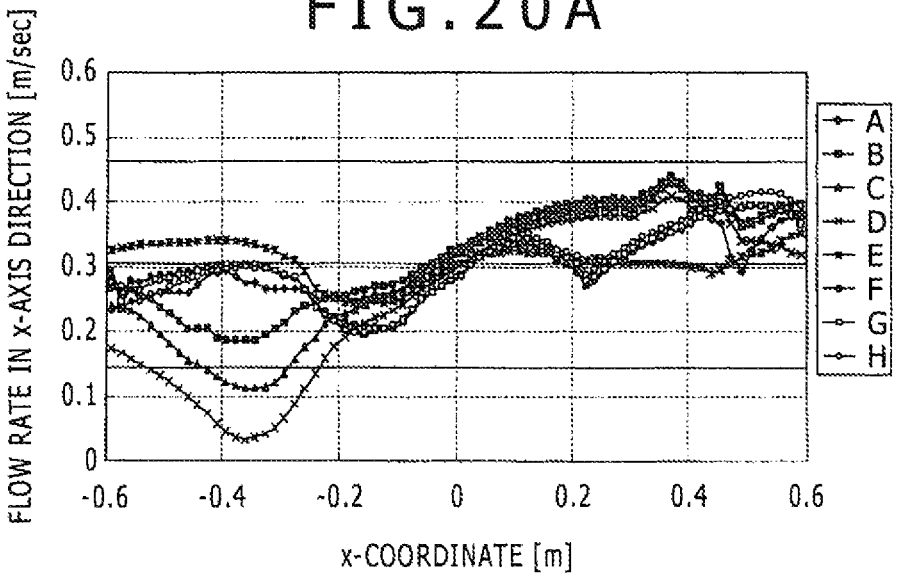
FIG. 20A is a graph showing flow rates measured on each line.
Figure 20B:
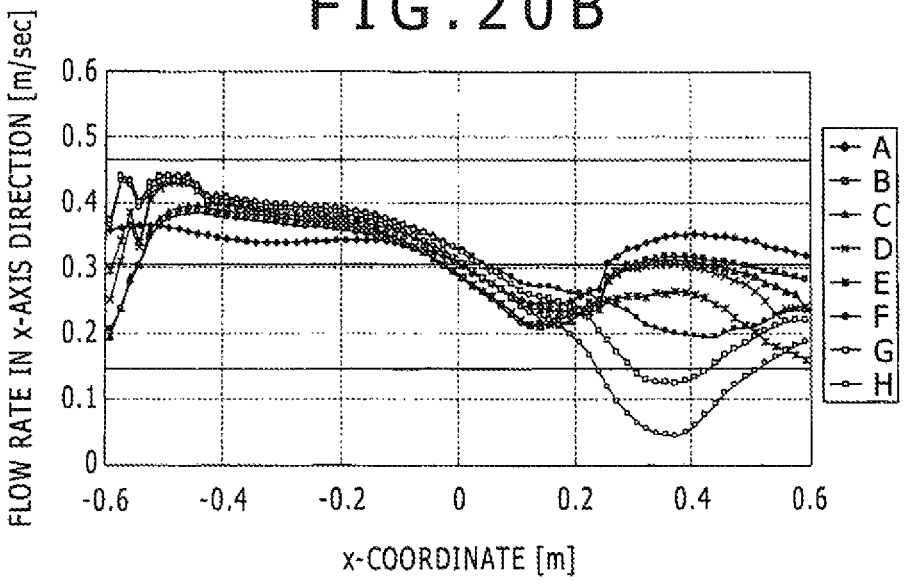
FIG. 20B is a graph showing the flow rates measured on each line.
Figure 21A:
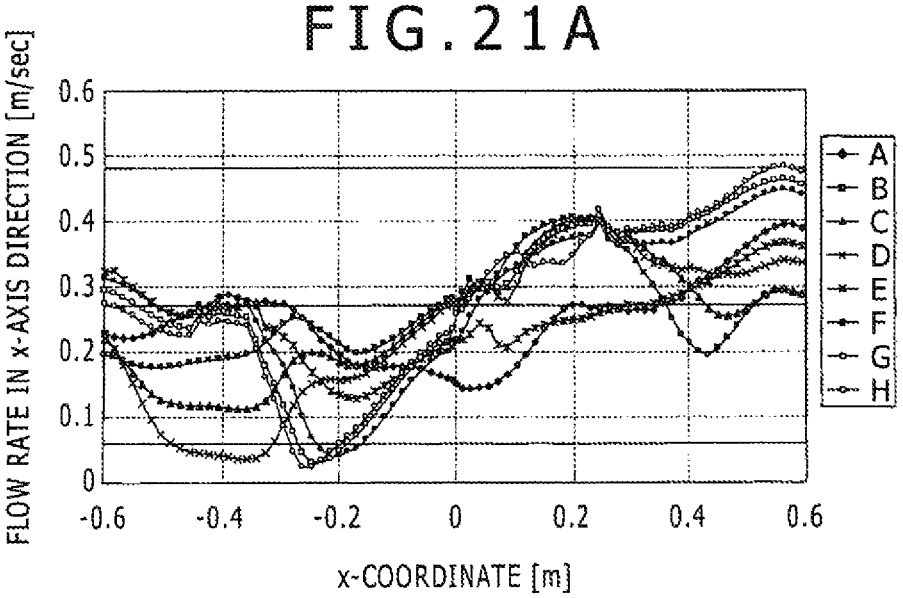
FIG. 21A is a graph showing flow rates measured on each line.
Figure 21B:
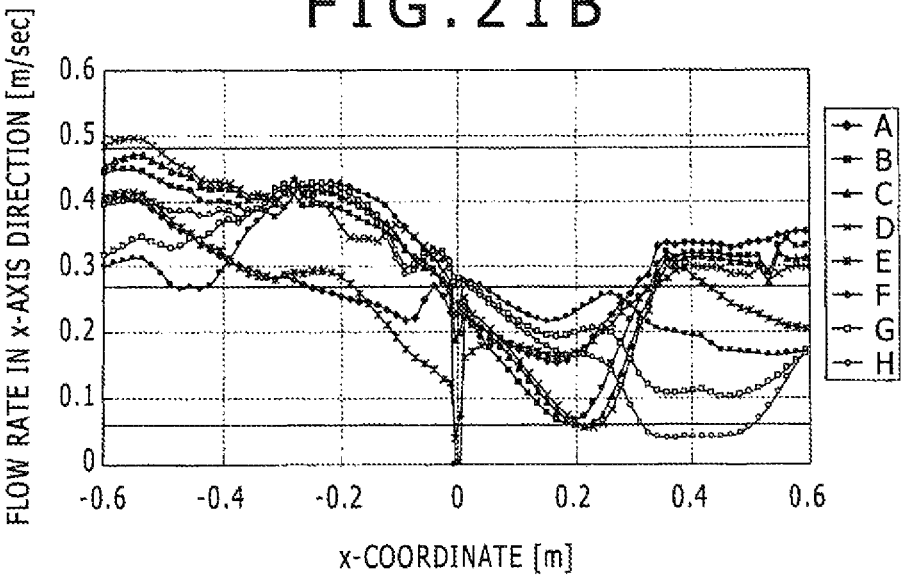
FIG. 21B is a graph showing the flow rates measured on each line.

Next, FIG. 20A shows the flow rates measured on the line 21 in Case 3, while FIG. 20B shows the flow rates measured on the line 22 in Case 3. The average flow rate on the line 22 is 305 mm/sec. Further, FIG. 21A shows the flow rates measured on the line 21 in Case 4, while FIG. 21B shows the flow rates measured on the line 22 in Case 4. The average flow rate on the line 22 is 271 mm/sec. It is found that as the stirring strength of the electromagnetic stirring increases, variations in the flow rates become larger, thus the flow is disturbed.

Figure 22A:
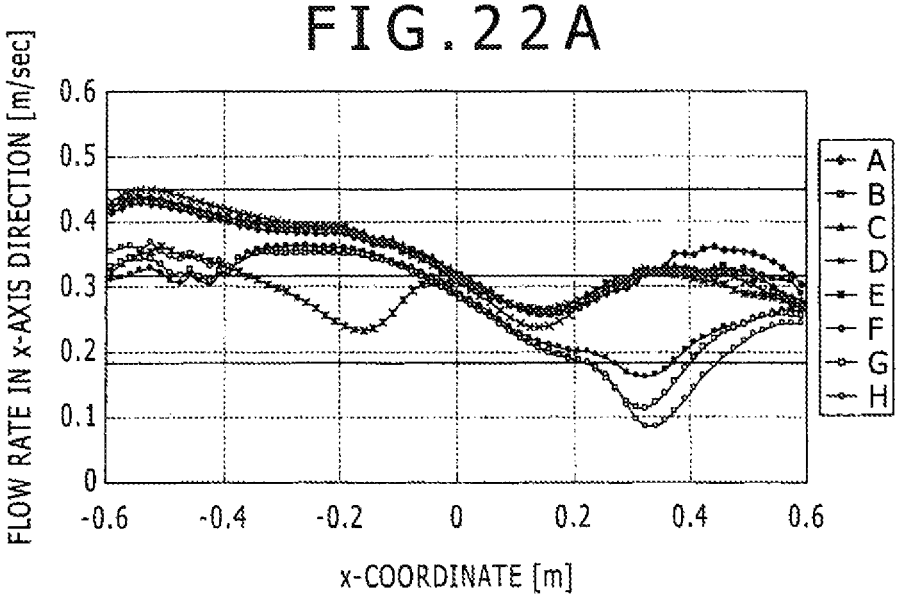
FIG. 22A is a graph showing flow rates measured on each line.
Figure 22B:
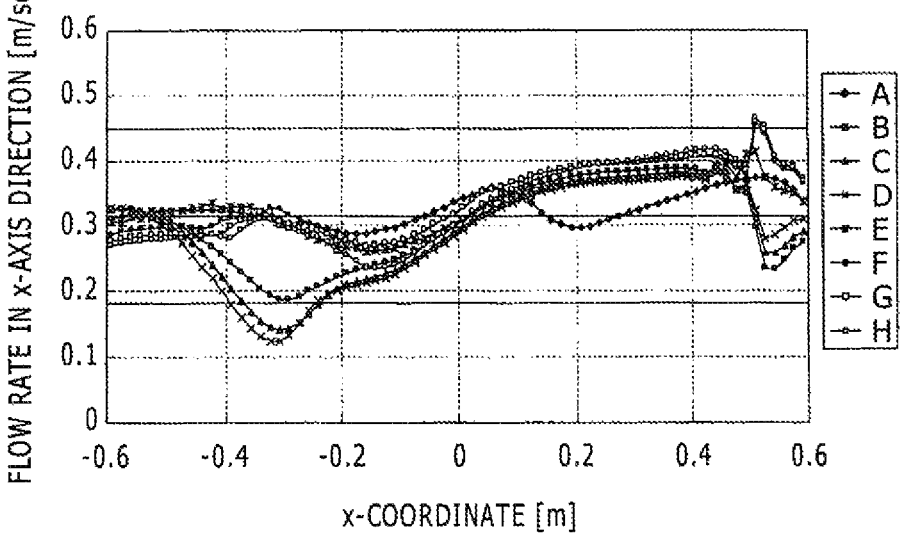
FIG. 22B is a graph showing the flow rates measured on each line.

Next, FIG. 22A shows the flow rates measured on the line 21 in Case 5, while FIG. 22B shows the flow rates measured on the line 22 in Case 5. The average flow rate on the line 22 is 316 mm/sec. It is found that a stable rotational flow can be obtained by performing the electromagnetic stirring in the opposite direction to the rotational direction of the plasma torches 7.

Figure 23A:
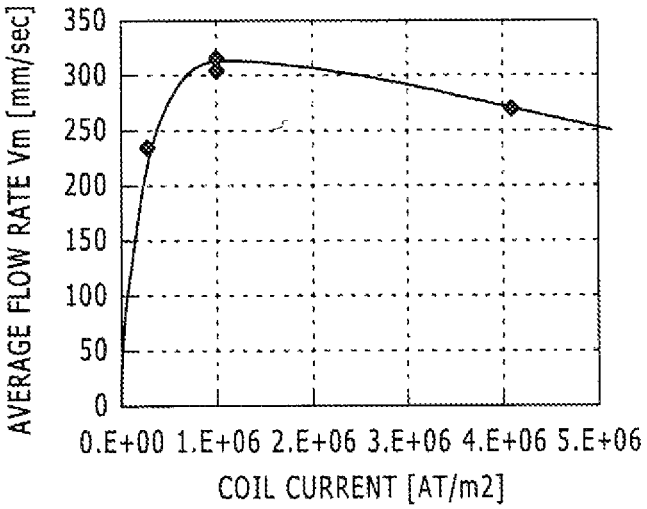
FIG. 23A is a graph showing the relation between coil current and average flow rates of molten metal.
Figure 23B:
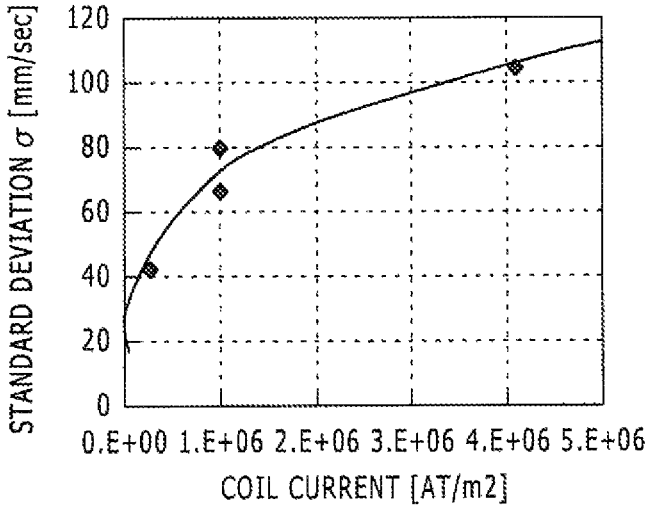
FIG. 23B is a graph showing the relation between the coil current and standard deviations of the flow rates.
Figure 23C:
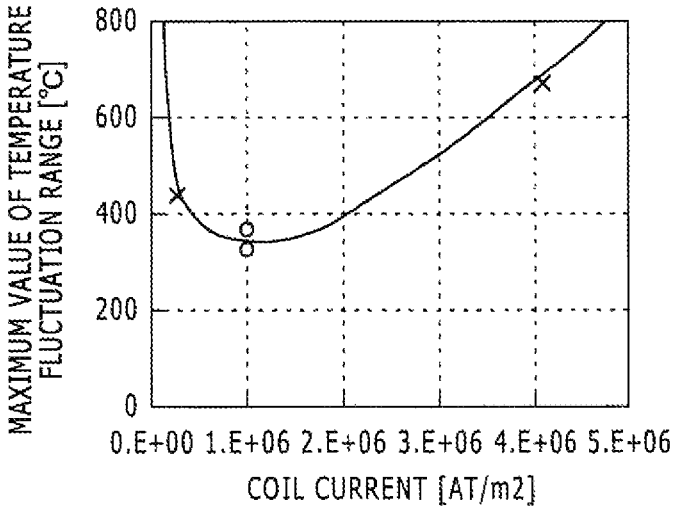
FIG. 23C is a graph showing the relation between the coil current and maximum values of temperature fluctuation ranges.

Next, FIG. 23A shows the relation between coil current and the average flow rates of the molten metal 12 in all Cases 1 to 5. It is found that the average flow rates decrease when the stirring strength is increased excessively. Further, FIG. 23B shows the relation between the coil current and standard deviations of the flow rates of the molten metal 12 in all Cases 1 to 5. It is found that the flow is disturbed when the stirring strength is increased. FIG. 23C shows the relation between the coil current and maximum values of the temperature fluctuation ranges in all Cases 1 to 5.

Figure 24A:
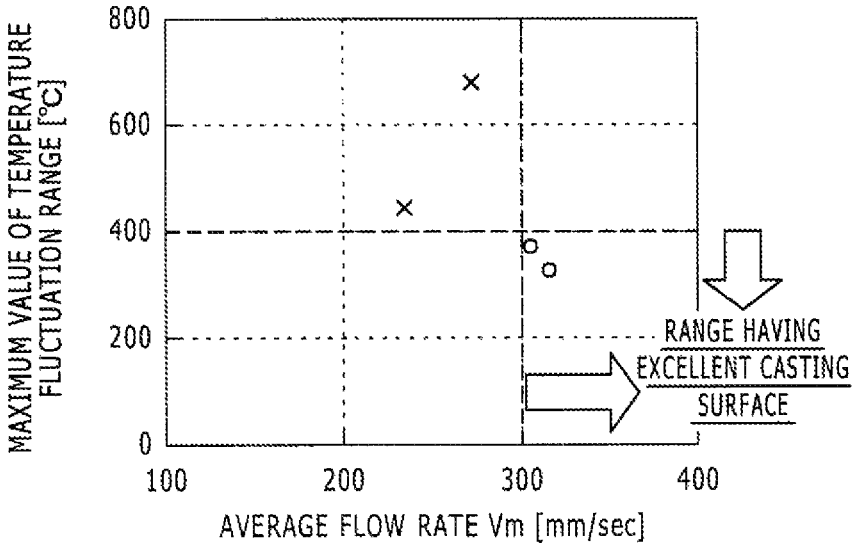
FIG. 24A is a graph showing the relation between average flow rates of molten metal and maximum values of temperature fluctuation ranges.
Figure 24B:
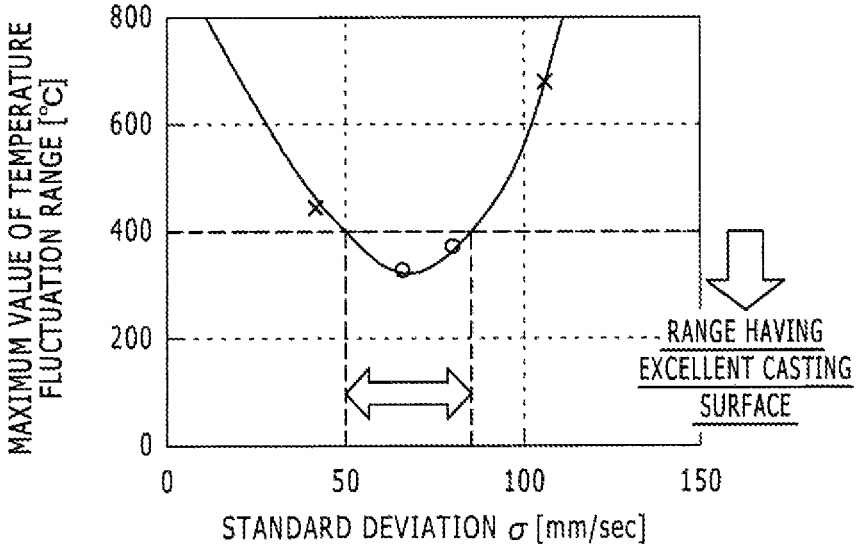
FIG. 24B is a graph showing the relation between standard deviations of the flow rates of the molten metal and the maximum values of the temperature fluctuation ranges.

Next, FIG. 24A shows the relation between the average flow rates of the molten metal 12 and the maximum values of the temperature fluctuation range. Further, FIG. 24B shows the relation between the standard deviations of the flow rates of the molten metal 12 and the maximum values of the temperature fluctuation ranges. It is found that the slab 11 having an excellent casting surface condition can be obtained by keeping the average flow rates Vm of the molten metal 12 in the x-axis direction to be 300 m/sec or more and the standard deviations σ of the flow rates Vx of the molten metal 12 in the x-axis direction to be in a range of 50 mm/sec≤σ≤85 mm/sec on the lines 21 and 22 shown in FIG. 5.

(Effects)

As described hereinabove, in the continuous casting method for a slab made of titanium or titanium alloy according to the present embodiments, in addition to the rotational movement of the plasma torch 7, the horizontally rotating flow is generated by the electromagnetic stirring at least on the surface of the molten metal 12 in the mold 2. In this configuration, the molten metal 12 with higher temperature staying at the long side parts of the mold 2 is moved to the short side and the corner parts of the mold 2, thus the melting of the initial solidified portion 15 at the long side parts of the mold 2 and the growth of the initial solidified portion 15 at short side and the corner parts of the mold 2 are alleviated. Consequently, solidification can take place evenly over the whole slab 11, thereby allowing the casting of the slab 11 having an excellent casting surface condition.

Further, in the vicinity of the mold walls at the long side parts of the mold 2, by setting the absolute values of the average values of the flow rates in the x-axis direction at the surface of the molten metal 12 located in the range of −2L/5≤x≤2L/5 to 300 mm/sec or more, the molten metal 12 with higher temperature staying at the long side parts of the mold 2 can be preferably moved to the short side and the corner parts of the mold 2.

Further, in the locations 10 mm away from the mold walls at the long side parts of the mold 2, by setting the absolute values of the average values of the flow rates in the x-axis direction at the surface of the molten metal 12 to 300 mm/sec or more, the molten metal 12 with higher temperature staying at the long side parts of the mold 2 can be preferably moved to the short side and the corner parts of the mold 2.

Further, by confining the standard deviations σ of the absolute values of the flow rates of the molten metal 12 in the x-axis direction, concerning to the variations due to locations and time in the range of 50 mm/sec≤σ≤85 mm/sec, the maximum values of the fluctuation ranges of the surface temperature of the slab 11 in the contact region where the molten metal 12 and the slab 11 contact with each other can be made 400° C. or less over the entire periphery of the slab 11.

Further, by generating the flow rotating in the opposite direction to the rotational direction of the plasma torch 7 at least on the surface of the molten metal 12, the fluctuation ranges of the surface temperature of the slab 11 can be reduced. Thus solidification can take place evenly over the whole slab 11.

Modifications of the Present Embodiments

The embodiments of the present invention are described hereinabove, however, it is obvious that the above embodiments solely serve as examples and are not to limit the present invention. The specific structures and the like of the present invention may be modified and designed according to the needs. Further, the actions and effects of the present invention described in the above embodiments are no more than most preferable actions and effects achieved by the present invention, thus the actions and effects of the present invention are not limited to those described in the above embodiments of the present invention.

The present application is based on Japanese Patent Application (Japanese Patent Application No. 2013-010247) filed on Jan. 23, 2013, the contents of which are incorporated herein by reference.

EXPLANATION OF REFERENCE NUMERALS

1 Continuous casting apparatus
2 Mold
3 Cold hearth
3*a* Pouring portion
4 Raw material charging apparatus
5 Plasma torch
6 Starting block
7 Plasma torch
11 Slab
12 Molten metal
13 Solidified shell
14 Air gap
15 Initial solidified portion

16 Contact region

21, 22 Lines

The invention claimed is:

1. A continuous casting method for continuously casting a slab made of titanium or a titanium alloy by injecting molten metal having titanium or a titanium alloy melted therein into a bottomless mold having a rectangular cross section and withdrawing the molten metal downward while being solidified, wherein a plasma torch is configured to horizontally rotate on the surface of the molten metal in the mold, a horizontally rotating flow is generated by electromagnetic stirring at least on the surface of the molten metal in the mold, when a length of a long side of the slab is denoted as L and a coordinate axis x is set in the long side direction of the slab, where the origin 0 lies at the central part thereof, in a vicinity of mold walls at long side parts of the mold, absolute values of average values of flow rates in the x-axis direction at the surface of the molten metal located in a range of $-2L/5 \leq x \leq 2L/5$ are set to 300 mm/sec or more, and the vicinity of the mold walls at the long side parts of the mold is a location 10 mm away from the mold walls at the long side parts of the mold.

2. The continuous casting method for the slab made of titanium or a titanium alloy according to claim 1, wherein standard deviations $\sigma$ of the absolute values of the flow rates of the molten metal in the x-axis direction, concerning to variations due to locations and time, are confined in a range of $50 \text{ mm/sec} \leq \sigma \leq 85 \text{ mm/sec}$.

3. The continuous casting method for the slab made of titanium or a titanium alloy according to claim 1, wherein a flow rotating in an opposite direction to a rotational direction of the plasma torch is generated at least on the surface of the molten metal.

4. A continuous casting method for continuously casting a slab made of titanium or a titanium alloy by injecting molten metal having titanium or a titanium alloy melted therein into a bottomless mold having a rectangular cross section and withdrawing the molten metal downward while being solidified, wherein a plasma torch is configured to horizontally rotate on the surface of the molten metal in the mold, a horizontally rotating flow is generated by electromagnetic stirring at least on the surface of the molten metal in the mold, when a length of a long side of the slab is denoted as L and a coordinate axis x is set in the long side direction of the slab, where the origin 0 lies at the central part thereof, in a vicinity of mold walls at long side parts of the mold, absolute values of average values of flow rates in the x-axis direction at the surface of the molten metal located in a range of $-2L/5 \leq x \leq 2L/5$ are set to 300 mm/sec or more, and standard deviations $\sigma$ of the absolute values of the flow rates of the molten metal in the x-axis direction, concerning to variations due to locations and time, are confined in a range of $50 \text{ mm/sec} \leq \sigma \leq 85 \text{ mm/sec}$.

* * * * *